US008422910B2

(12) United States Patent
Li et al.

(10) Patent No.: US 8,422,910 B2
(45) Date of Patent: Apr. 16, 2013

(54) SEALING MEMBER FOR USE WITH A TONER OR DEVELOPER SUPPLY CONTAINER

(75) Inventors: Kuan-Tung Li, Taichung County (TW); Yueh-Chun Lee, Taichung County (TW)

(73) Assignee: General Plastics Industrial Co., Ltd., Taichung (TW)

( * ) Notice: Subject to any disclaimer, the term of this patent is extended or adjusted under 35 U.S.C. 154(b) by 319 days.

(21) Appl. No.: 13/018,170

(22) Filed: Jan. 31, 2011

(65) Prior Publication Data

US 2012/0195626 A1 Aug. 2, 2012

(51) Int. Cl.
*G03G 15/08* (2006.01)

(52) U.S. Cl.
USPC ..... 399/106

(58) Field of Classification Search ..... 399/106, 399/258, 260, 262
See application file for complete search history.

(56) References Cited

U.S. PATENT DOCUMENTS 6,879,789 B2 * 4/2005 Yamada et al. ..... 399/106
6,920,298 B2 * 7/2005 Yamada et al. ..... 399/106
7,469,113 B2 * 12/2008 Yamada et al. ..... 399/106
7,647,012 B2 1/2010 Yamada et al.
7,672,609 B2 * 3/2010 Koyama et al. ..... 399/106
8,160,471 B2 * 4/2012 Jimba et al. ..... 399/106
8,290,394 B2 * 10/2012 Yamada et al. ..... 399/106

OTHER PUBLICATIONS

Affidavit of Amelia Garcia, Jan. 31, 2013.
Affidavit of Michael F. Falsone, Feb. 1, 2013.
Complaint for Patent Infringement, Case No. 1:10CV34 CMH/IDD, Jan. 12, 2010.

* cited by examiner

*Primary Examiner* — William J Royer
(74) *Attorney, Agent, or Firm* — Morris Manning & Martin LLP; Tim Tingkang Xia, Esq.

(57) ABSTRACT

A sealing member for unsealably sealing a toner opening of a toner or developer container mountable to an image forming apparatus. In one embodiment, a sealing member has a base member, a first coupling engagement portion and a second coupling engagement portion protruding away from the base member axially, a central member protruding away from the base member axially, wherein the central member has a cylindrical portion defining an opening therein, and at least one supporting member projected radially outwardly from the peripheral surface of the cylindrical portion, wherein the central member is formed to be concentric with the base member axially and positioned between the first coupling engagement portion and the second coupling engagement portion.

22 Claims, 8 Drawing Sheets

SEALING MEMBER FOR USE WITH A TONER OR DEVELOPER SUPPLY CONTAINER

FIELD OF THE PRESENT INVENTION

The present invention relates to a sealing member, and more particularly, to a sealing member for use with a toner or developer supply container for replenishing toner into an image forming apparatus such as an electrophotographic copying machine or a printer.

BACKGROUND OF THE PRESENT INVENTION

In a conventional electrophotographic image forming apparatus such as an electrophotographic copying machine or a printer, fine particles of toner are used as a developer. When the toner in a main assembly of the electrophotographic image forming apparatus is used up, the toner is supplied into the main assembly of the image forming apparatus using a toner accommodating container (toner supply container).

Because the toner is in the form of very fine powder, it is known to place, upon a toner supplying operation, a toner supply container inside the main assembly of the image forming apparatus and to gradually supply the toner through a small opening to avoid scattering of the toner.

Any one of the above-described toner supply containers receives a driving force from the main assembly of the image forming apparatus to drive a feeding member in the toner supply container or a main body itself to discharge the toner.

As for such a drive transmitting means, there are many existing conventional mechanisms. For example, such a conventional mechanism is disclosed in U.S. Pat. No. 7,647,012 and shown in FIGS. 1-2. It is understood that a toner bottle 1 is generally cylindrical, and one end thereof is provided at a center with an opening 1*a* by a projected portion. The diameter of the opening 1*a* is smaller than the diameter of a cylindrical portion 1A, which is a main body of the bottle. The opening 1*a* is plugged with a sealing member 2 for sealing the opening 1*a*, which is configured such that the opening 1*a* is unsealed and resealed automatically by the sliding motion of the sealing member 2 relative to the toner bottle 1 in the longitudinal directions (arrows a and b) of the toner bottle 1.

At the free end portion of the sealing member 2, there is formed a cylindrical portion having an engaging projection 3 and a releasing force receiving portion 4 for disengaging from a driving portion 20 provided in a main assembly of apparatus, and such a portion of the cylindrical portion which supports the engaging projection and the releasing force receiving portion 4 is elastically deformable (in order to enhance or assist the elastic deformation, slits are formed at lateral sides of the region so as to extend to the free end of the cylindrical portion).

The engaging projection 3 is engaged with the driving portion 20 and functions to transmit the rotation force from the driving portion 20 to the toner bottle 1 through the engagement between the sealing member 2 and the driving portion 20.

In FIGS. 1 and 2, the main body 1A of the toner bottle is provided with the opening 1*a* at the one longitudinal end surface thereof, and a driving shaft 1*b* (portion to be engaged) is projected out of the opening 1*a*, the driving shaft 1*b* being integral with the main body 1A of the toner bottle and being provided in the opening 1*a*. The driving shaft 1*b* is disposed substantially coaxially with the opening 1*a*, and is slidably engaged with an engaging hole (not shown) formed in the sealing member 2.

The driving shaft 1*b* functions to transmit the rotational driving force from the main assembly of the apparatus to the main body 1A of the toner bottle through the sealing member 2, and the cross-sectional configuration of the driving shaft 1*b* is non-circular, for example, rectangular configuration, H shape, D shape or the like to transmit the rotational driving force. The driving shaft 1*b* is fixed on the main body 1A of the toner bottle by proper means.

The sealing member 2 has a sealing portion 2*b* for unsealably sealing the opening 1*a* of the toner bottle 1, and a coupling engagement portion 2*c* (cylindrical portion) in the form of a cylinder engageable with the driving portion 20 of the main assembly of the apparatus. An outer diameter of a large diameter portion of the sealing portion 2*b* is larger than the inner diameter of the opening 1*a* by a proper degree. The sealing portion 2*b* is press-fitted into the opening 1*a*, by which the opening 1*a* (toner supply opening) is sealed by the sealing member 2.

The coupling engagement portion 2*c* of the sealing member 2 has the engaging projection 3 for receiving the driving force from the main assembly of the apparatus, and slits 2*e* formed at lateral ends of the engaging projection 3. The engaging projection 3 is projected radially outwardly from the peripheral surface of the cylindrical portion of the coupling engagement portion 2*c*. The engaging projection 3 performs three different functions, namely, a coupling function for receiving the rotational driving force from the main assembly of apparatus, a transmitting function of transmitting the rotation to the toner bottle 1, and a locking function (retention function) for permitting relative sliding motion between the sealing member 2 and the main body 1A of the toner bottle 1 so as to automatically open and close the opening.

However, the conventional structures involve some problems. Among other things, first, because the coupling engagement portion 2*c* of the sealing member 2 is rather rigid, the impact of the driving force on the engaging projection 3 may not be easily absorbed by the coupling engagement portion 2*c*, which may lead to a speed wear and tear of the engaging projection 3 and other complications. Second, the rigidity of the coupling engagement portion 2*c* of the sealing member 2 may not facilitate a smooth engagement of the coupling engagement portion 2*c* of the sealing member 2 and a corresponding locking hole 20*h* formed in the driving portion 20 of the main assembly of apparatus, which also has an engaging rib 20*a* for rotating the toner bottle 1, and the engaging rib 20*a* abuts a drive receiving surface 3*a* to transmit the rotational driving force to the sealing member 2 after the engaging projection 3 is engaged with the locking hole 20*h*.

Therefore, a heretofore unaddressed need exists in the art to address the aforementioned deficiencies and inadequacies.

SUMMARY OF THE PRESENT INVENTION

In one aspect, the present invention relates to a sealing member for unsealably sealing a toner opening of a toner or developer container mountable to an image forming apparatus.

In one embodiment, the sealing member has a base member having a center, a first surface and a second, opposite surface, a first cylindrical portion protruding away from the second, opposite surface and a second cylindrical portion protruding away from the first cylindrical portion axially.

The sealing member further has a first coupling engagement portion protruding away from the first surface of the base member axially, wherein the first coupling engagement portion is formed with a curved, first end portion at an end distal from the first surface and a second end portion at an end proximate to the first surface, and wherein the first coupling engagement portion further comprises an engaging projection projected radially outwardly from the peripheral surface of the first coupling engagement portion.

The sealing member also has a second coupling engagement portion protruding away from the first surface of the base member axially, wherein the second coupling engagement portion is formed with a curved, first end portion at an end distal from the first surface and a second end portion at an end proximate to the first surface, and wherein the second coupling engagement portion further comprises an engaging projection projected radially outwardly from the peripheral surface of the second coupling engagement portion.

In one embodiment, the first coupling engagement portion and the second coupling engagement portion are formed symmetrically around an axial axis A passing through the center of the base member.

The sealing member has a central member protruding away from the first surface of the base member axially, wherein the central member has a cylindrical portion defining an opening therein, and at least one supporting member, projected radially outwardly from the peripheral surface of the cylindrical portion, wherein the central member is formed to be concentric with the base member axially and positioned between the first coupling engagement portion and the second coupling engagement portion.

In one embodiment, the first cylindrical portion and the second cylindrical portion are concentric with the central member. The second surface of the base member is circular and has a diameter $d_b$, the first cylindrical portion has a diameter $d_c$, and the second cylindrical portion has a diameter $d_d$, and wherein $d_b$, $d_c$, and $d_d$ satisfy the following relationship: $d_b>d_c>d_d$.

In one embodiment, the base member further has a plate member concentrically formed on the second cylindrical portion, a first engaging arm member projecting away from the plate member and a second engaging arm member projecting away from the plate member, and wherein the first engaging arm member and the second engaging arm member are formed at opposite ends of a diameter of the plate member, wherein each of the first engaging arm member and the second engaging arm member has a hooking member, formed at an open end and extending outwardly from the body portion of each of the first engaging arm member and the second engaging arm member.

In one embodiment, the base member, the first cylindrical portion, the second cylindrical portion, the plate member, the first engaging arm member, and the second engaging arm member are configured and sized to allow the first engaging arm member and the second engaging arm member to be press-fitted into the toner opening of a toner or developer container so that the toner opening of a toner or developer container is sealed at least by the base member.

In one embodiment, each of the hooking member, is formed with a partially tapered engagement portion, which removably engages with the toner or developer container after the first engaging arm member and the second engaging arm member are press-fitted into the toner opening of the toner or developer container.

In one embodiment, the curved, first end portion of the first coupling engagement portion is formed with a first end portion, and an opposite, second end portion, wherein each of the first end portion, and the opposite, second end portion has an end surface, and a side surface along the axial axis A. The at least one supporting member, comprises a first supporting member and an opposite, second supporting member, and wherein each of the first supporting member and the opposite, second supporting member has an end surface.

In one embodiment, as formed, the end surface of each of the first end portion, and the opposite, second end portion, and the end surface of each of the first supporting member and the opposite, second supporting member are in a same plane perpendicular to the axial axis A.

In another aspect, the present invention relates to a toner or developer container mountable to an image forming apparatus. In one embodiment, the toner or developer container has a container body having an inner space configured and positioned to contain toner or developer; a feeding portion configured and positioned to feed the toner in said container body to discharge the toner out of said container body through an opening; and a sealing member for unsealably sealing the opening and coupling to an image forming apparatus in operation, wherein the sealing member has inventive features set forth above.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

Further features and benefits of the present invention will be apparent from a detailed description of preferred embodiments thereof taken in conjunction with the following drawings, wherein similar elements are referred to with similar reference numbers, and wherein.

DETAILED DESCRIPTION OF THE PRESENT INVENTION

Figure 1:
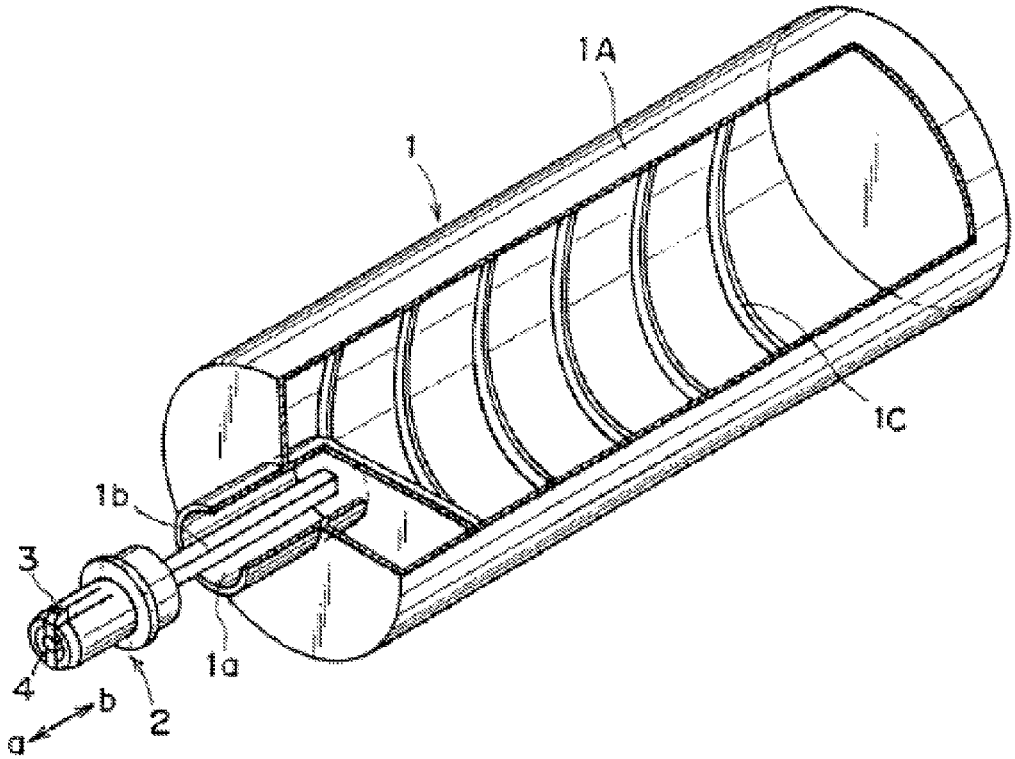
FIG. 1 (Prior Art)
FIG. 1 shows a partly broken perspective view of a conventional toner supply container.
Figure 2:
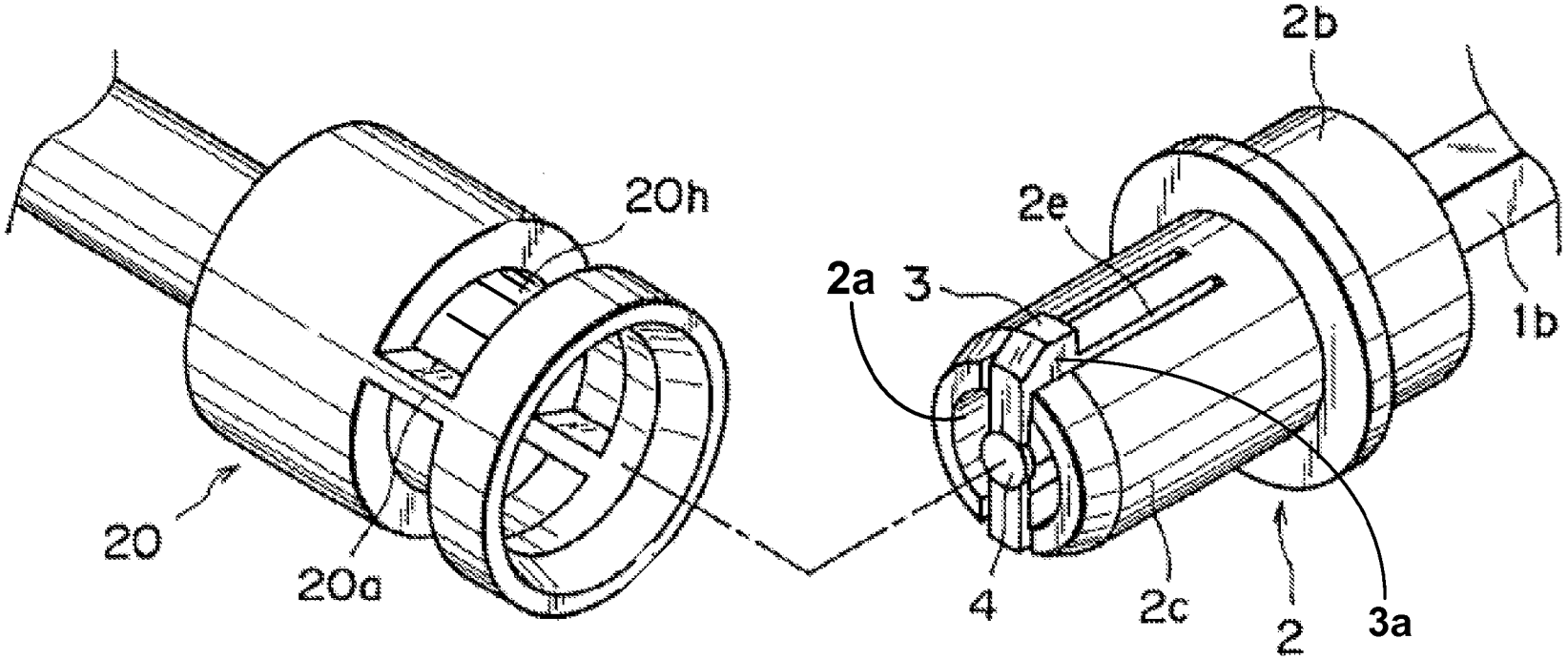
FIG. 2 (Prior Art)
FIG. 2 shows a perspective view of a driving force transmitting portion of an image forming apparatus and a driving force receiving portion of a conventional toner supply container.

The present invention is more particularly described-in the following examples that are intended to be illustrative only since numerous modifications and variations therein will be apparent to those skilled in the art. Various embodiments of the invention are now described in detail. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings. In accordance with the purposes of this invention, as embodied and broadly described herein, this invention, in one aspect, relates to a toner supplying container detachably mountable to an image forming apparatus.

Figure 3:
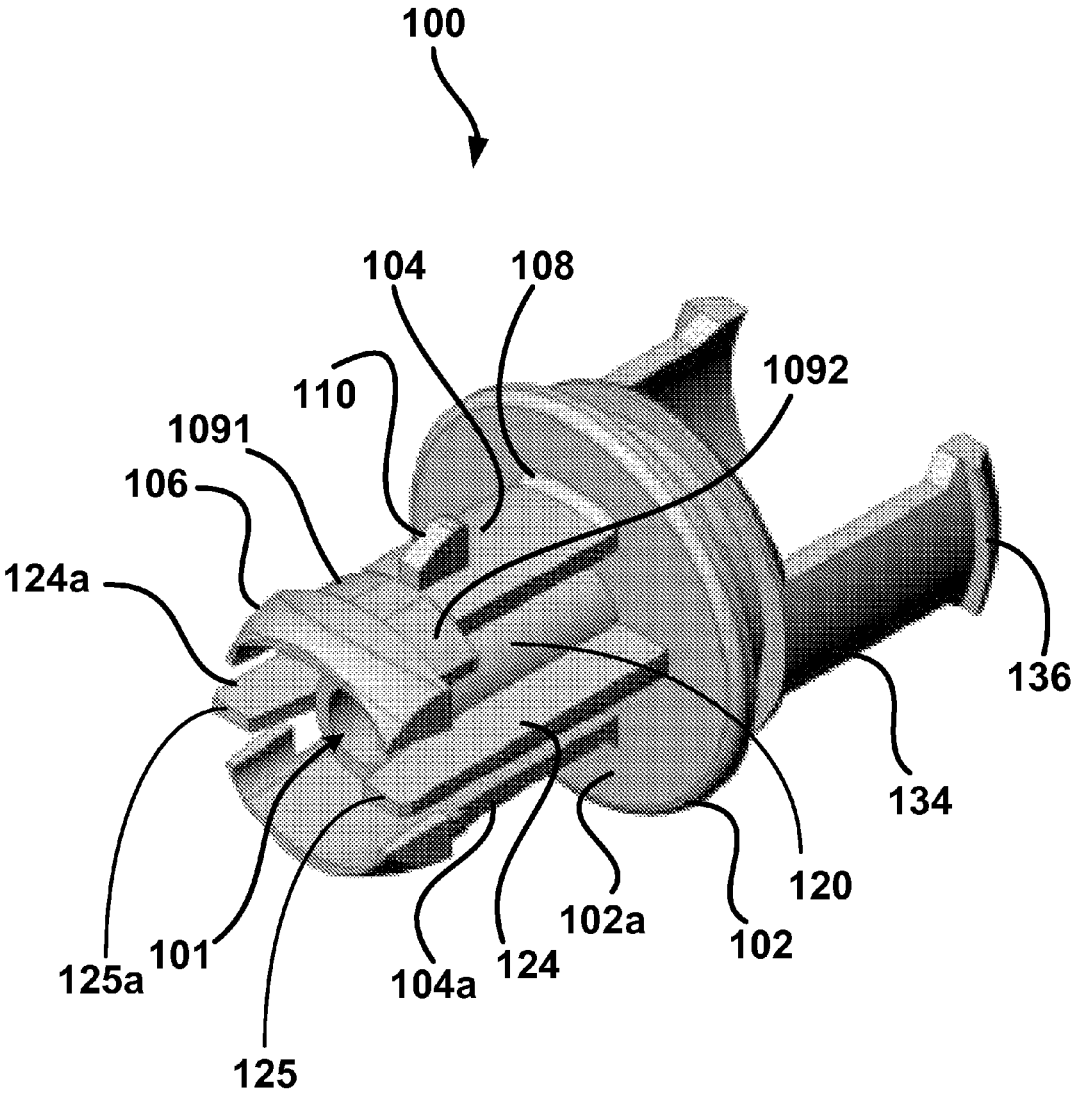
FIG. 3 is an exploded perspective view of a sealing member for unsealably sealing a toner opening of a toner or developer container according to one embodiment of the present invention.

Referring in general to FIGS. 3-8, and in particular to FIG. 3 first, in one aspect, the present invention relates to sealing member 100 for unsealably sealing a toner opening of a toner or developer container mountable to an image forming apparatus. As it is shown, a sealing member 100 has a base member 102, a first coupling engagement portion 104 and a second coupling engagement portion 104*a* protruding away from the base member 102 axially, a central member 120 protruding away from the base member 102 axially, wherein the central member 120 has a cylindrical portion 122 defining an opening 101 therein, and at least one supporting member 124, 124*a* projected radially outwardly from the peripheral surface of the cylindrical portion 122, wherein the central member 120 is formed to be concentric with the base member 102 axially and positioned between the first coupling engagement portion 104 and the second coupling engagement portion 104*a*.

More specifically, in one embodiment, the sealing member 100 has a base member 102 having a center 102*f*, a first surface 102*a* and a second, opposite surface 102*b*, a first cylindrical portion 102*c* protruding away from the second, opposite surface 102*b* and a second cylindrical portion 102*d* protruding away from the first cylindrical portion 102*c* axially.

The sealing member 100 further has at least one coupling engagement portion. In one embodiment, the sealing member 100 has a first coupling engagement portion 104 protruding away from the first surface 102*a* of the base member 102 axially, wherein the first coupling engagement portion 104 is formed with a curved, first end portion 106 at an end distal from the first surface 102*a* and a second end portion 108 at an end proximate to the first surface 102*a*. The first coupling engagement portion 104 further has an engaging projection 110 projected radially outwardly from the peripheral surface of the first coupling engagement portion 104. In addition, the first coupling engagement portion 104 also includes a pair of tabs 1091, 1092 formed between the curved first end portion 106 and the engaging projection 110, extending towards the first surface 102*a* from the curved first end portion 106, and curved substantially in accordance with the curved first end portion 106. The pair of tabs 1091, 1092 of the first coupling engagement portion 104 is formed symmetrically about the engaging projection 110.

The sealing member 100 in one embodiment also has a second coupling engagement portion 104*a* protruding away from the first surface 102*a* of the base member 102 axially, wherein the second coupling engagement portion 104*a* is formed with a curved, first end portion 106*a* at an end distal from the first surface 102*a* and a second end portion 108*a* at an end proximate to the first surface 102*a*. The second coupling engagement portion 104*a* further has an engaging projection 110*a* projected radially outwardly from the peripheral surface of the second coupling engagement portion 104*a*. The second coupling engagement portion 104*a* also includes a pair of tabs 1091*a*, 1092*a* formed between the curved first end portion 106*a* and the engaging projection 110*a*, extending towards the first surface 102*a* from the curved first end portion 106*a*, and curved substantially in accordance with the curved first end portion 106*a*. The pair of tabs 1091*a*, 1092*a* of the second coupling engagement portion 104*s* is formed symmetrically about the engaging projection 110*a*. Further, the first coupling engagement portion 104 and the second coupling engagement portion 104*a* are formed symmetrically around an axial axis A passing through the center 102*f* of the base member 102. Both of the first coupling engagement portion 104 and the second coupling engagement portion 104*a* are formed with resilient material.

The sealing member 100 has the central member 120 protruding away from the first surface 102*a* of the base member 102 axially. The central member 120 has a cylindrical portion 122 defining an opening 120*a* therein, and at least one supporting member 124, 124*a* projected radially outwardly from the peripheral surface of the cylindrical portion 122. As formed, the central member 120 is formed to be concentric with the base member 102 axially and positioned between the first coupling engagement portion 104 and the second coupling engagement portion 104*a*.

Figure 4:
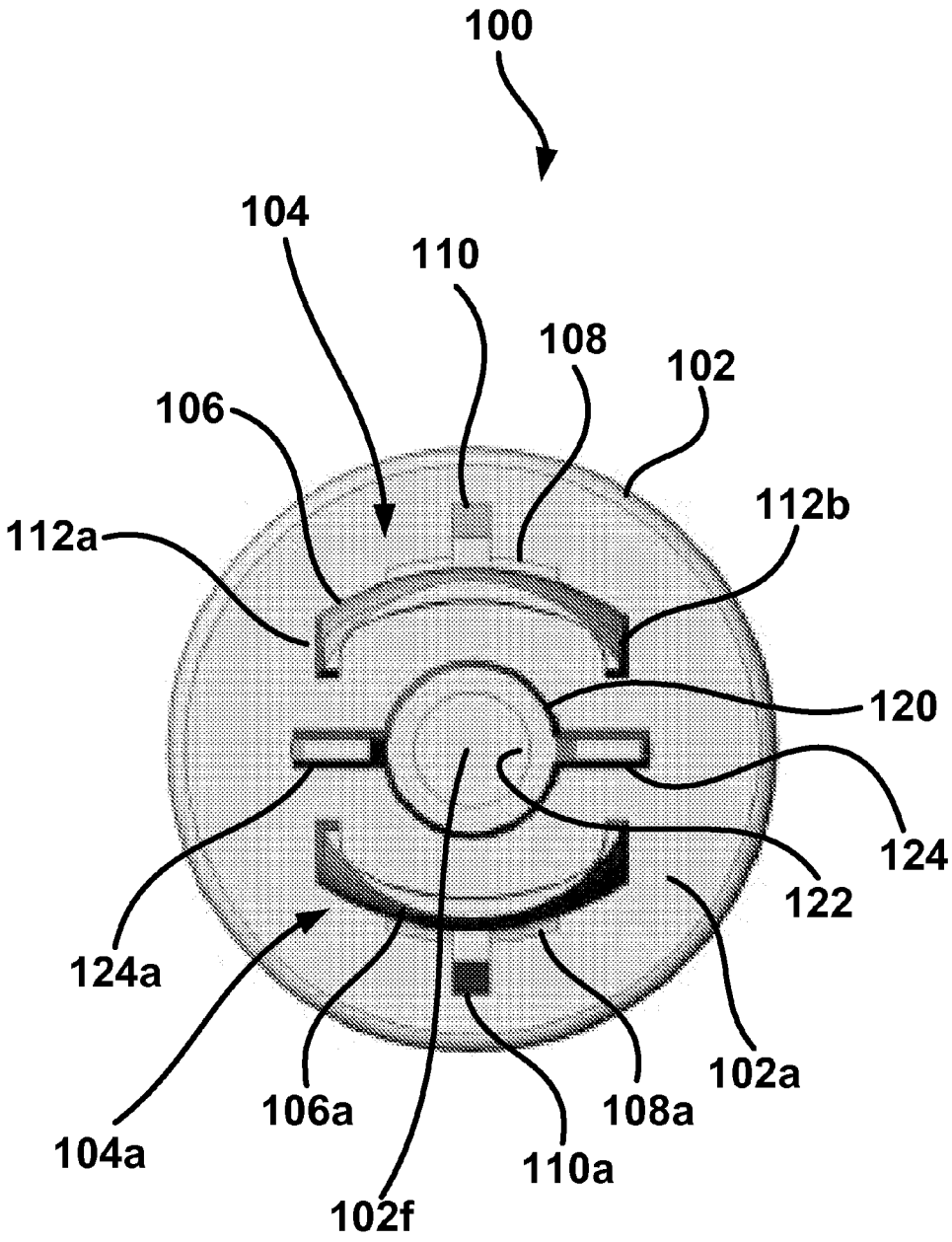
FIG. 4 shows schematically a top view of a sealing member for unsealably sealing a toner opening of a toner or developer container according to one embodiment of the present invention as shown in FIG. 3.
Figure 5:
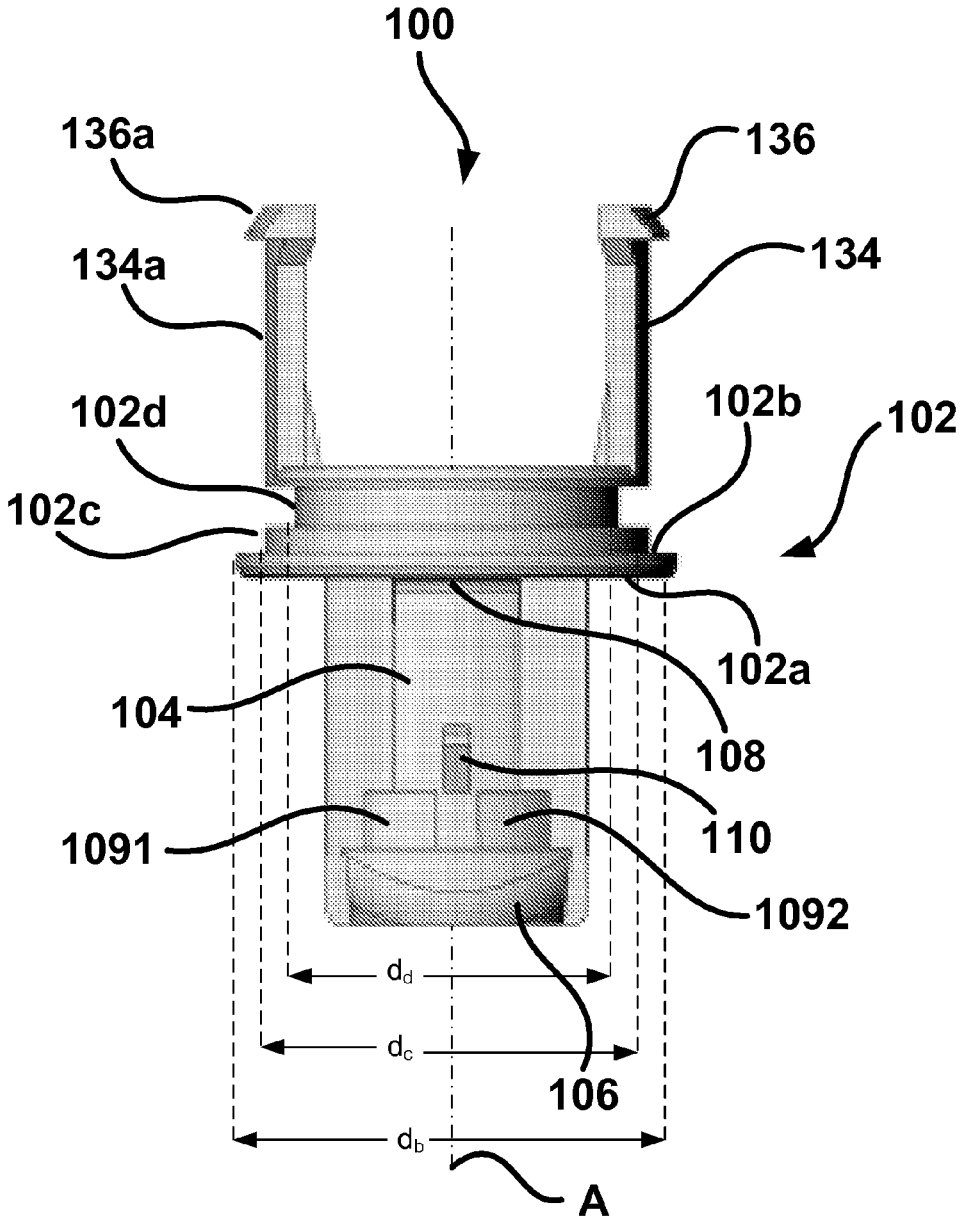
FIG. 5 shows schematically a first side view of a sealing member for unsealably sealing a toner opening of a toner or developer container according to one embodiment of the present invention as shown in FIG. 3.
Figure 7:
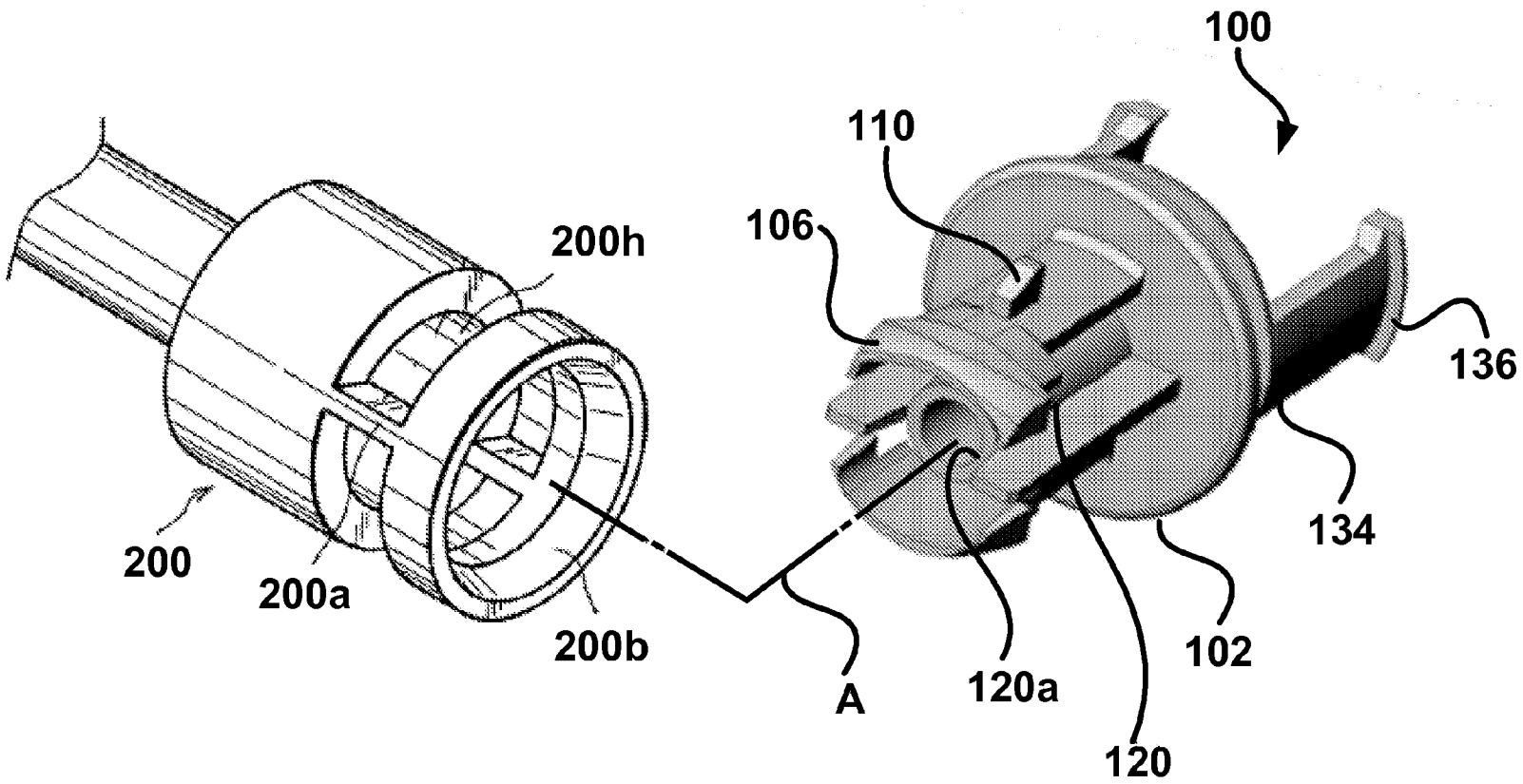
FIG. 7 shows a perspective view of a driving force transmitting portion of an image forming apparatus and a sealing member for unsealably sealing a toner opening of a toner or developer container according to one embodiment of the present invention as shown in FIG. 3.

In one embodiment, the at least one supporting member 124, 124*a* includes a first supporting member 124 and a second supporting member 124*a*. The first supporting member 124 is formed to be projecting radially outwardly from the peripheral surface of the cylindrical portion 122 at an end of a diameter of the cylindrical portion 122, and the second supporting member 124*a* is formed to be projecting radially outwardly from the peripheral surface of the cylindrical portion 122 at the other, opposite end of a diameter of the cylindrical portion 122, respectively. As formed, the first supporting member 124 and the second supporting member 124*a* are positioned strategically between the first coupling engagement portion 104 and the second coupling engagement portion 104*a* such that in operation, as shown in FIGS. 4 and 7, when the sealing member 100 is introduced in a press-fitting manner into a receiving hole 200*b* of a driving portion 200 provided in a main assembly of an imaging forming apparatus, the first coupling engagement portion 104 and the second coupling engagement portion 104*a* will be pressed and thus move centripetally towards to the cylindrical portion 122 but they, in particular, the curved, first end portion 106 and the curved, second end portion 106*a*, will be buttressed by the first supporting member 124 and the second supporting member 124*a* when they reach the first supporting member 124 and the second supporting member 124*a*. In this way, accidental break of each or both of the first coupling engagement portion 104 and the second coupling engagement portion 104*a* will be avoided.

In one embodiment, the first cylindrical portion 102*c* and the second cylindrical portion 102*d* are formed to be concentric with the central member 120. The second surface 102*b* of the base member 102 is circular and has a diameter db, the first cylindrical portion 102*c* has a diameter dc, and the second cylindrical portion 102*d* has a diameter dd, where diameters db, dc, and dd satisfy the following relationship: db>dc>dd . As such formed, there is a first step formed between the base member 102 and the first cylindrical portion 102*c*, and there is a second step formed between the first cylindrical portion 102*c* and the second cylindrical portion 102*d*. The first step and second step are sized properly such that when the sealing member 100 is introduced a toner or developer container such as the toner bottle 1 as shown in FIG. 1, the sealing portion, which includes the base member 102, the first cylindrical portion 102*c*, the second cylindrical portion 102*d*, a plate member 102*e*, a first engaging arm member 134 and a second engaging arm member 134*a*, is press-fitted into the opening 1*a*, by which the opening 1*a* (toner supply opening) is sealed by the sealing member 100, and the first step and second step are in particular engaged with corresponding engaging structures formed on the interior surface of the opening 1*a* to provide a tight sealing.

Figure 6:
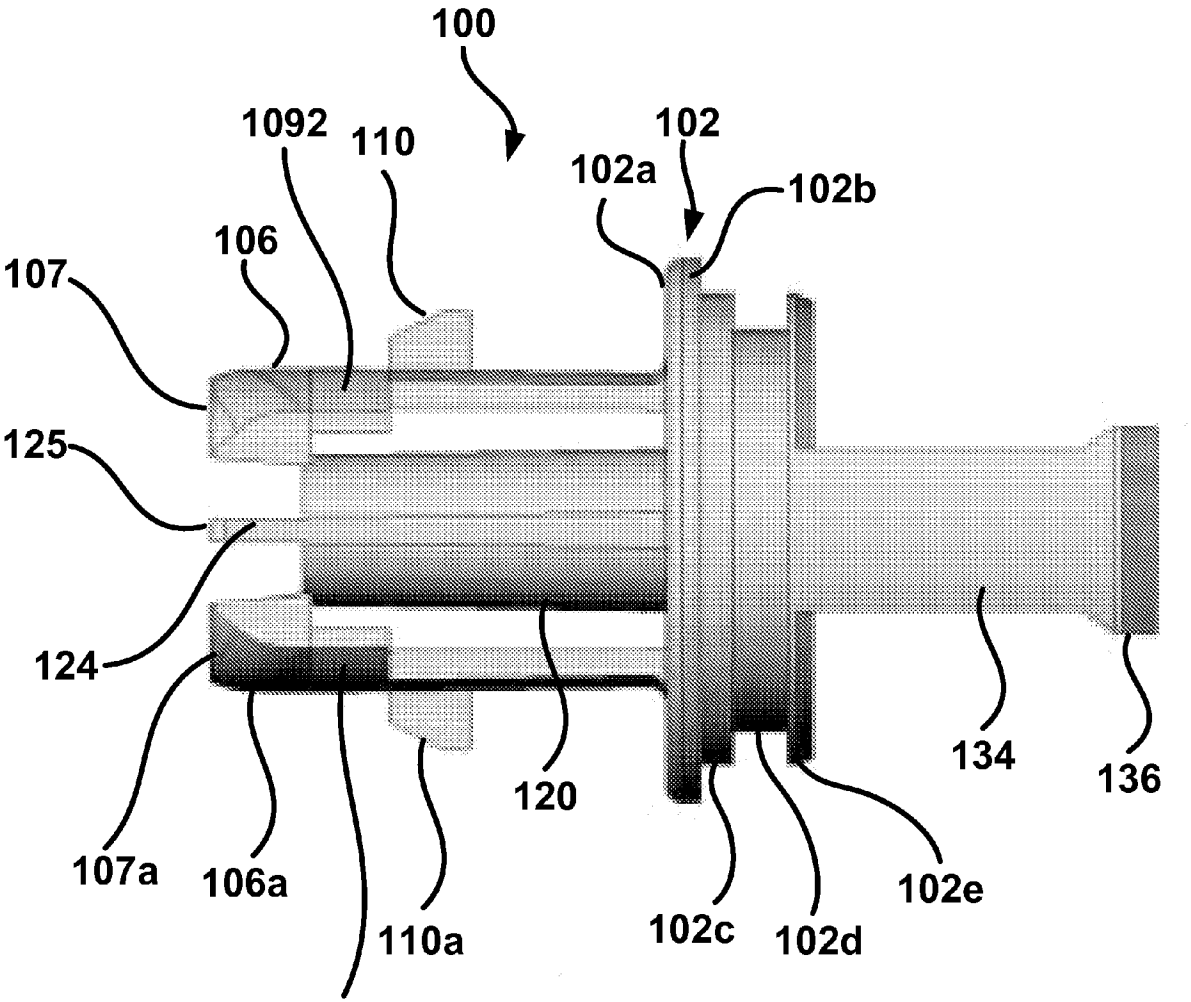
FIG. 6 shows schematically a second side view of a sealing member for unsealably sealing a toner opening of a toner or developer container according to one embodiment of the present invention as shown in FIG. 3.
Figure 8:
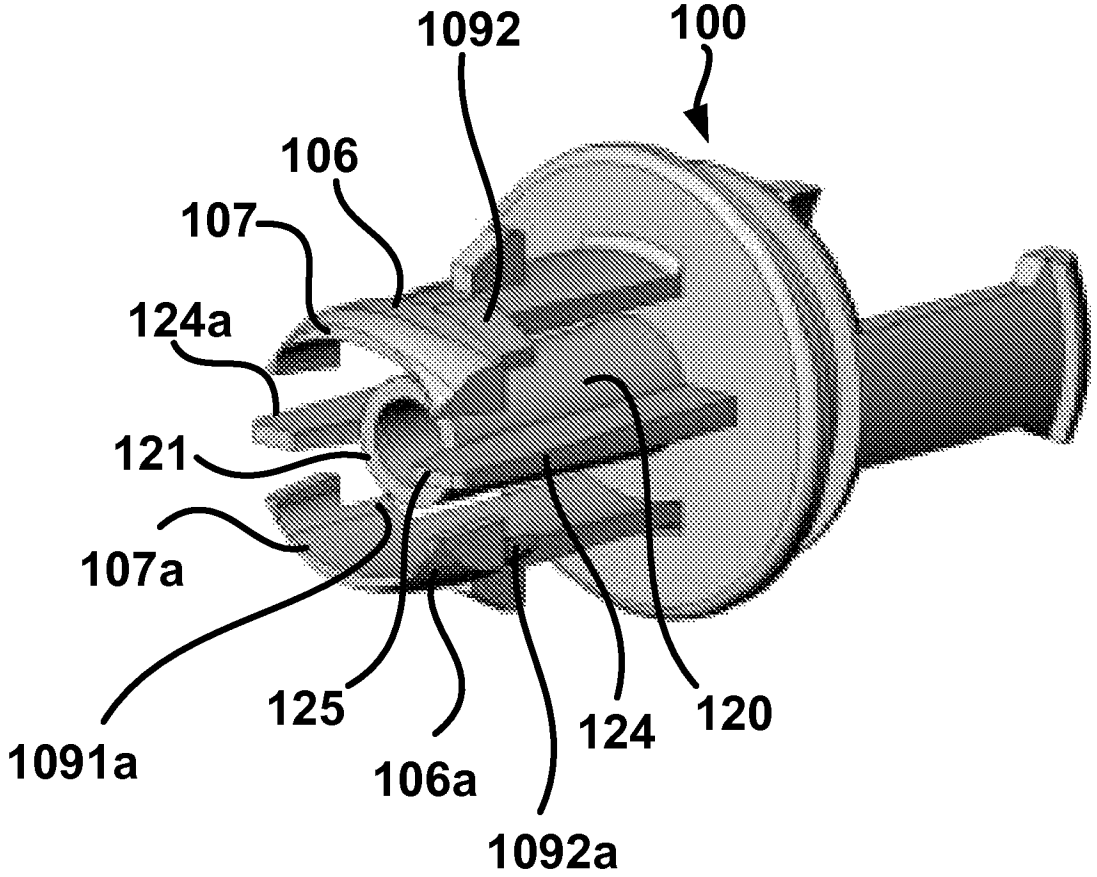
FIG. 8 is a perspective view of a sealing member for unsealably sealing a toner opening of a toner or developer container according to one embodiment of the present invention as shown in FIG. 3.

In one embodiment, in particular referring to FIGS. 6-8, the base member 102 further has the plate member 102*e* concentrically formed on the second cylindrical portion 102*d*, the first engaging arm member 134 projecting away from the plate member 102*e* and the second engaging arm member 134*a* projecting away from the plate member 102*e*. The first engaging arm member 134 and the second engaging arm member 134*a* are formed at opposite ends of a diameter of the plate member 102*e*. The first engaging arm member 134 has a hooking member 136 formed at an open end and extending outwardly from the body portion of the first engaging arm member 134. Likewise, the second engaging arm member 134*a* has a hooking member 136*a* formed at an open end and extending outwardly from the body portion of the second engaging arm member 134*a*.

In one embodiment, the base member 102, the first cylindrical portion 102*c*, the second cylindrical portion 102*d*, the plate member 102*e*, the first engaging arm member 134, and the second engaging arm member 134*a* are configured and sized to allow the first engaging arm member 134 and the second engaging arm member 134*a* to be press-fitted into the toner opening of a toner or developer container so that the toner opening of a toner or developer container is sealed at least by the base member 102.

In one embodiment, each of the hooking member 136, 136*a* is formed with a partially tapered engagement portion, which removably engages with the toner or developer container after the first engaging arm member 134 and the second engaging arm member 134*a* are press-fitted into the toner opening of the toner or developer container.

In one embodiment, the curved, first end portion 106 of the first coupling engagement portion 104 is formed with a first end portion 112*a*, and an opposite, second end portion 112*b*, where each of the first end portion 112*a*, and the opposite, second end portion 112*b* has an end surface 107, 107*a* and a side surface along the axial axis A. Each of the first supporting member 124 and the opposite, second supporting member 124*a* is formed to have an end surface 125, 125*a*.

In one embodiment, as formed, the end surface 107, 107*a* of each of the first end portion 112*a*, and the opposite, second end portion 112*b*, and the end surface 125, 125*a* of each of the first supporting member 124 and the opposite, second supporting member 124*a* are in a same plane perpendicular to the axial axis A. However, the cylindrical portion 122 of the central member 120 is formed with an open end 121, which is between the end surface 125 of the first supporting member 124 and the first surface 102*a* of the base member 102 axially. This configuration allows the curved, first end portion 106 and the curved, second end portion 106*a* to have more moving space towards each other when they are pressed.

In another aspect, the present invention relates to a toner or developer container mountable to an image forming apparatus. In one embodiment, the toner or developer container has a container body, such as toner body 1 as shown in FIG. 1, having an inner space configured and positioned to contain toner or developer, a feeding portion, such as ridges 1C formed therein the toner body 1, configured and positioned to feed the toner in the toner body 1 to discharge the toner out of the toner body 1 through the opening 1*a*, and a sealing member 100 for unsealably sealing the opening and coupling to an image forming apparatus in operation, where the sealing member 100 has inventive features set forth above and in one embodiment as shown in FIGS. 3-8.

In operation, as partially shown in FIG. 7, when such a toner or developer container with an inventive sealing member 100 is mounted to an image forming apparatus with the driving portion 200, the free end portion of the sealing member 100 is received into the receiving hole 200*b* of the driving portion 200, where the first coupling engagement portion 104 and the second coupling engagement portion 104*a* of the sealing member 100 will be pressed to allow a smooth engagement between the driving portion 200 and the sealing member 100. The curved, first end portion 106 and the curved, second end portion 106*a* are sized to allow them to be slidable inside the receiving hole 200*b* against the interior of the driving portion 200 defining the receiving hole 200*b*, further facilitating the engagement. When the engagement between the driving portion 200 and the sealing member 100 is completed, the engaging projections 110, 110*a* or at least one of them, will be received into a corresponding locking hole 200*h* formed in the driving portion 200 of the main assembly of apparatus, which also has an engaging rib 200*a* for abutting the engaging projections 110, 110*a* or at least one of them to transmit a rotational driving force to the sealing member 100 so as to rotate the toner or developer container.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modification, both as to equipment details and operating procedures can be effected without departing from the scope of the invention itself. Further, it should be understood that, although the present invention has been described with reference to specific details of certain embodiments thereof, it is not intended that such details should be regarded as limitations upon the scope of the invention except as and to the extent that they are included in the accompanying claims.

What is claimed is:

1. A sealing member for unsealably sealing a toner opening of a toner or developer container mountable to an image forming apparatus, comprising:

(a) a base member having a center, a first surface and a second, opposite surface, a first cylindrical portion protruding away from the second, opposite surface and a second cylindrical portion protruding away from the first cylindrical portion axially;

(b) a first coupling engagement portion protruding away from the first surface of the base member axially, wherein the first coupling engagement portion is formed with a curved, first end portion at an end distal from the first surface and a second end portion at an end proximate to the first surface, and wherein the first coupling engagement portion further comprises an engaging projection projected radially outwardly from the peripheral surface of the first coupling engagement portion;

(c) a second coupling engagement portion protruding away from the first surface of the base member axially, wherein the second coupling engagement portion is formed with a curved, first end portion at an end distal from the first surface and a second end portion at an end proximate to the first surface, and wherein the second coupling engagement portion further comprises an engaging projection projected radially outwardly from the peripheral surface of the second coupling engagement portion, and wherein the first coupling engagement portion and the second coupling engagement portion are formed symmetrically around an axial axis A passing through the center of the base member; and (d) a central member protruding away from the first surface of the base member axially, wherein the central member has a cylindrical portion defining an opening therein, and at least one supporting member projected radially outwardly from the peripheral surface of the cylindrical portion, wherein the central member is formed to be concentric with the base member axially and positioned between the first coupling engagement portion and the second coupling engagement portion.

2. The sealing member of claim 1, wherein the first cylindrical portion and the second cylindrical portion are concentric with the central member.

3. The sealing member of claim 2, wherein the second surface of the base member is circular and has a diameter $d_b$, the first cylindrical portion has a diameter $d_c$, and the second cylindrical portion has a diameter $d_d$, and wherein $d_b$, $d_c$, and $d_d$ satisfy the following relationship: $d_b > d_c > d_d$.

4. The sealing member of claim 3, wherein the base member further has a plate member concentrically formed on the second cylindrical portion, a first engaging arm member projecting away from the plate member and a second engaging arm member projecting away from the plate member, and wherein the first engaging arm member and the second engaging arm member are formed at opposite ends of a diameter of the plate member.

5. The sealing member of claim 4, wherein each of the first engaging arm member and the second engaging arm member has a hooking member formed at an open end and extending outwardly from a body portion of each of the first engaging arm member and the second engaging arm member.

6. The sealing member of claim 5, wherein the base member, the first cylindrical portion, the second cylindrical portion, the plate member, the first engaging arm member, and the second engaging arm member are configured and sized to allow the first engaging arm member and the second engaging arm member to be press-fitted into the toner opening of a toner or developer container so that the toner opening of a toner or developer container is sealed at least by the base member.

7. The sealing member of claim 6, wherein each of the hooking member is formed with a partially tapered engagement portion, which removably engages with the toner or developer container after the first engaging arm member and the second engaging arm member are press-fitted into the toner opening of the toner or developer container.

8. The sealing member of claim 1, wherein the curved, first end portion of the first coupling engagement portion is formed with a first end portion, and an opposite, second end portion, wherein each of the first end portion, and the opposite, second end portion has an end surface, and a side surface along the axial axis A.

9. The sealing member of claim 8, wherein the at least one supporting member, comprises a first supporting member and an opposite, second supporting member, and wherein each of the first supporting member and the opposite, second supporting member has an end surface.

10. The sealing member of claim 9, wherein, as formed, the end surface of each of the first end portion, and the opposite, second end portion, and the end surface of each of the first supporting member and the opposite, second supporting member are in a same plane perpendicular to the axial axis A.

11. The sealing member of claim 1, wherein each of the first coupling engagement portion and the second coupling engagement portion further comprises a pair of tabs formed between the curved first end portion and the engaging projection, extending towards the first surface from the curved first end portion, and curved substantially in accordance with the curved first end portion, wherein the pair of tabs of each of the first coupling engagement portion and the second coupling engagement portion is formed symmetrically about the engaging projection.

12. A toner or developer container mountable to an image forming apparatus, comprising:

(a) a container body having an inner space configured and positioned to contain toner or developer;

(b) a feeding portion configured and positioned to feed the toner in said container body to discharge the toner out of said container body through an opening; and (c) a sealing member for unsealably sealing the opening and coupling to an image forming apparatus in operation, wherein the sealing member for unsealably sealing the opening of a toner or developer container mountable to an image forming apparatus, wherein the sealing member comprises:

(i) a base member having a center, a first surface and a second, opposite surface, a first cylindrical portion protruding away from the second, opposite surface and a second cylindrical portion protruding away from the first cylindrical portion axially;

(ii) a first coupling engagement portion protruding away from the first surface of the base member axially, wherein the first coupling engagement portion is formed with a curved, first end portion at an end distal from the first surface and a second end portion at an end proximate to the first surface, and wherein the first coupling engagement portion further comprises an engaging projection projected radially outwardly from the peripheral surface of the first coupling engagement portion;

(iii) a second coupling engagement portion protruding away from the first surface of the base member axially, wherein the second coupling engagement portion is formed with a curved, first end portion at an end distal from the first surface and a second end portion at an end proximate to the first surface, and wherein the second coupling engagement portion further comprises an engaging projection projected radially outwardly from the peripheral surface of the second coupling engagement portion, and wherein the first coupling engagement portion and the second coupling engagement portion are formed symmetrically around an axial axis A passing through the center of the base member; and (iv) a central member protruding away from the first surface of the base member axially, wherein the central member has a cylindrical portion defining an opening therein, and at least one supporting member projected radially outwardly from the peripheral surface of the cylindrical portion, wherein the central member is formed to be concentric with the base member axially and positioned between the first coupling engagement portion and the second coupling engagement portion.

13. The toner or developer container of claim 12, wherein the first cylindrical portion and the second cylindrical portion are concentric with the central member.

14. The toner or developer container of claim 13, wherein the second surface of the base member is circular and has a diameter $d_b$, the first cylindrical portion has a diameter $d_c$, and the second cylindrical portion has a diameter $d_d$, and wherein $d_b$, $d_c$, and $d_d$ satisfy the following relationship: $d_b > d_c > d_d$.

15. The toner or developer container of claim 14, wherein the base member further has a plate member concentrically formed on the second cylindrical portion, a first engaging arm member projecting away from the plate member and a second engaging arm member projecting away from the plate member, and wherein the first engaging arm member and the second engaging arm member are formed at opposite ends of a diameter of the plate member.

16. The toner or developer container of claim 15, wherein each of the first engaging arm member and the second engaging arm member has a hooking member formed at an open end and extending outwardly from a body portion of each of the first engaging arm member and the second engaging arm member.

17. The toner or developer container of claim 16, wherein the base member, the first cylindrical portion, the second cylindrical portion, the plate member, the first engaging arm member, and the second engaging arm member are configured and sized to allow the first engaging arm member and the second engaging arm member to be press-fitted into the toner opening of a toner or developer container so that the toner opening of a toner or developer container is sealed at least by the base member.

18. The toner or developer container of claim 17, wherein each of the hooking member is formed with a partially tapered engagement portion, which removably engages with the toner or developer container after the first engaging arm member and the second engaging arm member are press-fitted into the toner opening of the toner or developer container.

19. The toner or developer container of claim 18, wherein the curved, first end portion of the first coupling engagement portion is formed with a first end portion, and an opposite, second end portion, wherein each of the first end portion, and the opposite, second end portion has an end surface and a side surface along the axial axis A.

20. The toner or developer container of claim 19, wherein the at least one supporting member comprises a first supporting member and an opposite, second supporting member, and wherein each of the first supporting member and the opposite, second supporting member has an end surface.

21. The toner or developer container of claim 20, wherein, as formed, the end surface of each of the first end portion, and the opposite, second end portion, and the end surface of each of the first supporting member and the opposite, second supporting member are in a same plane perpendicular to the axial axis A.

22. A sealing member for unsealably sealing a toner opening of a toner or developer container mountable to an image forming apparatus, comprising:

(a) a base member having a center, a first surface and a second, opposite surface, a first cylindrical portion protruding away from the second, opposite surface and a second cylindrical portion protruding away from the first cylindrical portion axially;

(b) a first coupling engagement portion protruding away from the first surface of the base member axially, wherein the first coupling engagement portion is formed with a curved, first end portion at an end distal from the first surface and a second end portion at an end proximate to the first surface, and wherein the first coupling engagement portion further comprises an engaging projection projected radially outwardly from the peripheral surface of the first coupling engagement portion, and a pair of tabs formed between the curved first end portion and the engaging projection, extending towards the first surface from the curved first end portion, and curved substantially in accordance with the curved first end portion, wherein the pair of tabs is formed symmetrically about the engaging projection;

(c) a second coupling engagement portion protruding away from the first surface of the base member axially, wherein the second coupling engagement portion is formed with a curved, first end portion at an end distal from the first surface and a second end portion at an end proximate to the first surface, and wherein the second coupling engagement portion further comprises an engaging projection projected radially outwardly from the peripheral surface of the second coupling engagement portion, and a pair of tabs formed between the curved first end portion and the engaging projection, extending towards the first surface from the curved first end portion, and curved substantially in accordance with the curved first end portion, wherein the pair of tabs is formed symmetrically about the engaging projection, and wherein the first coupling engagement portion and the second coupling engagement portion are formed symmetrically around an axial axis A passing through the center of the base member; and (d) a central member protruding away from the first surface of the base member axially, wherein the central member has a cylindrical portion defining an opening therein, and at least one supporting member projected radially outwardly from the peripheral surface of the cylindrical portion, wherein the central member is formed to be concentric with the base member axially and positioned between the first coupling engagement portion and the second coupling engagement portion.

* * * * *